United States Patent [19]

Lissau

[11] 3,964,108

[45] June 22, 1976

[54] DEOSEPTIC ASSEMBLY FOR BEDPAN RINSER

[75] Inventor: Frederic Lissau, Chicago, Ill.

[73] Assignee: Sloan Valve Company, Franklin Park, Ill.

[22] Filed: Nov. 20, 1974

[21] Appl. No.: 525,357

[52] U.S. Cl. ..... 4/7; 4/223; 4/226

[51] Int. Cl.[2] ..... A47K 3/22; A47K 11/08

[58] Field of Search ..... 4/1, 145, 10, 227, 226, 4/225, 7, 6, 150, 166, 192, 224, 223; 137/616, 616.5; 251/78, 80; 222/193; 239/315

[56] References Cited

UNITED STATES PATENTS

| | | | |
|---|---|---|---|
| 2,703,408 | 3/1955 | Gray | 4/7 |
| 3,083,375 | 4/1963 | Jewell | 4/7 |
| 3,419,911 | 1/1969 | Wood | 4/10 |
| 3,623,167 | 11/1971 | Syrenne et al. | 4/225 |
| 3,629,872 | 12/1971 | Parkison | 4/10 |
| 3,646,617 | 3/1972 | Heald | 4/1 |
| 3,842,447 | 10/1974 | Usher | 4/226 |

*Primary Examiner*—Henry K. Artis
*Attorney, Agent, or Firm*—Kinzer, Plyer, Dorn & McEachran

[57] ABSTRACT

The deoseptic assembly is supported directly from the diverter valve assembly of a bedpan rinser apparatus and includes a deoseptic valve member rotatable with the diverter valve and employing a cavitating venturi to aspirate a quantity of sanitizing fluid into the bedpan spray arm to mix with the water flow when the flush valve is actuated. The container for the sanitizing fluid is supported from the deoseptic valve housing attached to the diverter valve assembly. A novel check valve and flow control valve are included in the deoseptic assembly.

16 Claims, 3 Drawing Figures

DEOSEPTIC ASSEMBLY FOR BEDPAN RINSER

BACKGROUND OF THE INVENTION

In prior bedpan rinser apparatus the deoseptic assembly was usually supported apart and from the diverter valve assembly by an extending bracket and the container of sanitizing fluid was connected to the diverter valve by external flexible hose connections. The aspirating arrangement was also usually supported adjacent the end of the spray arm. This combination presented an unsightly, awkward appearance, especially when arranged alongside the former offset connection of the flush tube above the toilet bowl. In addition, the aspiration was accomplished by a concentric tube venturi in the spray arm. This arrangement created an unnecessary restriction of flow in the spray arm and was difficult to manufacture and assemble properly.

It is accordingly an object of the invention to provide a new and improved deoseptic assembly for bedpan rinser apparatus which avoids the above disadvantages. Another object is to provide a novel deoseptic valve which is easy to assemble, compact, and which is incorporated within the structure of the diverter valve assembly, thereby eliminating the need for external piping and presenting a more streamlined appearance.

A further object of the invention is to accomplish the aspiration of sanitizing fluid without restricting the flow of flushing water through the diverter assembly. These and other objects and advantages of the invention will become more readily apparent upon consideration of the following description and drawings.

SUMMARY OF THE INVENTION

The deoseptic valve assembly is fastened to and supported directly upon the diverter valve member and is rotatable therewith when the spray arm is moved down into the bedpan rinsing position. A housing is attached to one end of the diverter valve member and encloses one end of the deoseptic valve member. The deoseptic valve member is rotatable in its housing and the housing is held in place by a snap ring. Aspirating flow passages extend through the deoseptic valve member into the diverter valve member, and the passages include a cavitating venturi and a flow control valve in the deoseptic valve member, and a check valve in the housing. A container for sanitizing fluid is supported from the housing and a hollow vent pin in the housing is received in a notch in the diverter valve casing to prevent rotation of the housing and container when the deoseptic valve member is rotated. The vent pin also serves to maintain atmospheric pressure in the container.

BRIEF DESCRIPTION OF THE DRAWINGS

Referring specifically to the drawings in which a preferred embodiment of the invention is illustrated and in which like parts are referred to by like numerals.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
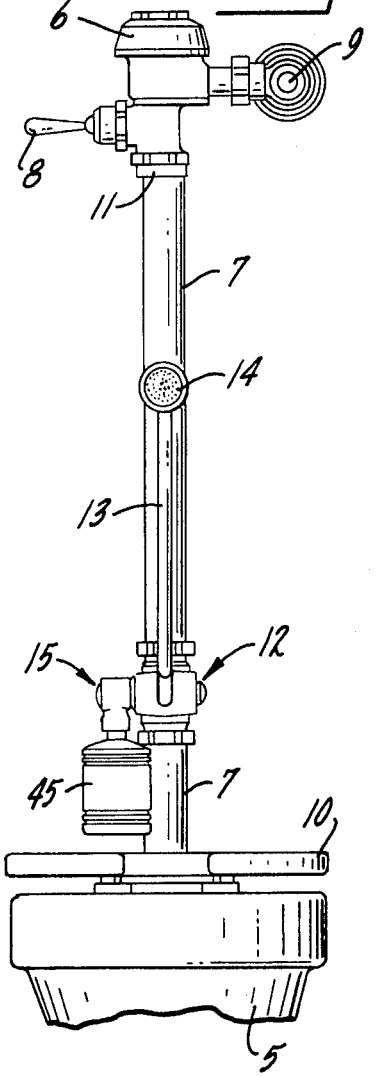
FIG. 1 is a front elevation of the apparatus shown in combination with a conventional toilet bowl and flush valve.

Referring now specifically to the drawings, FIG. 1 illustrates a conventional flush type toilet 5 which is provided with a flush valve 6, such as "SLOAN" flush valve connected by the flush pipe 7 to the toilet bowl 5 for flushing the same whenever the handle 8 on the flush valve 6 is actuated. The inlet water supply line is connected to the control stop 9 and an open front toilet seat 10 is hinged to the top of the toilet bowl 5. A vacuum breaker 11 is connected in the flush pipe 7 below the flush valve 6 to prevent back siphonage. The parts enumerated so far are of common and well known construction.

The bedpad rinsing apparatus is indicated generally at 12 and is interposed in the flush pipe 7 between the flush valve 6 and the toilet bowl 5. The apparatus 12 includes a spray arm 13 having a spout 14 at its end. For a detailed description of the construction and operation of the bedpan rinsing apparatus 12, reference is made to the Application of Henry R. Billeter filed Oct. 23, 1973 as Ser. No. 408,375 and assigned to the same interests.

Figure 2:
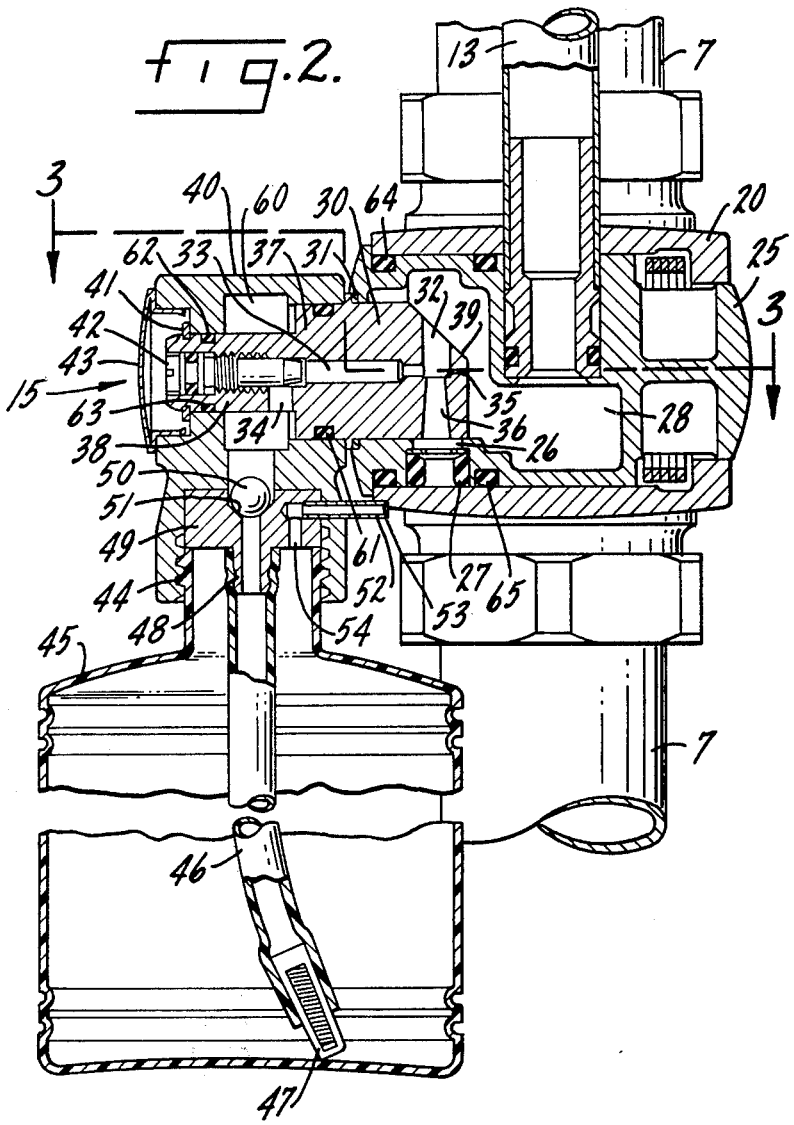
FIG. 2 is a sectional front view of the diverter valve and deoseptic assembly.
Figure 3:
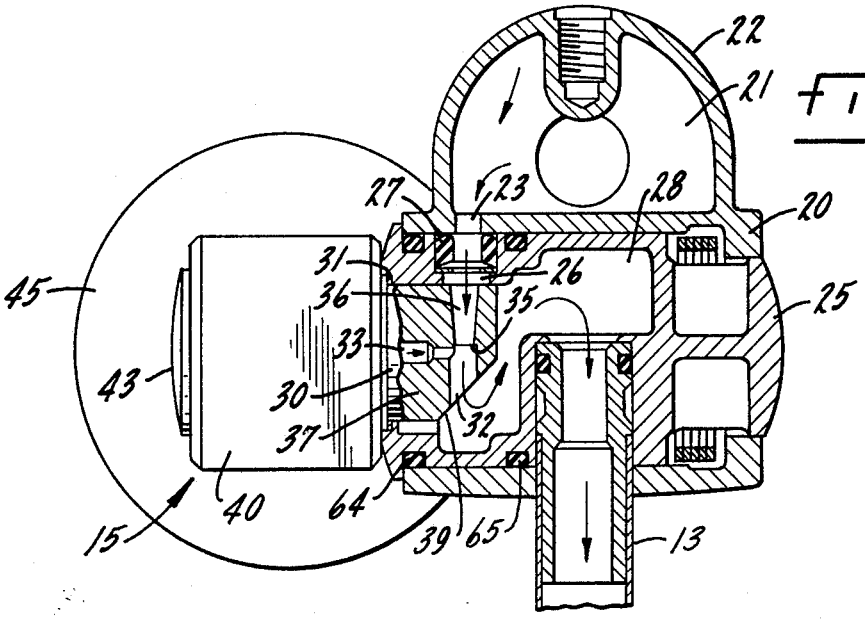
FIG. 3 is a sectional top view taken along line 3—3 of FIG. 2 with the spray arm in the bedpan rinsing position.

The deoseptic assembly is indicated generally at 15 and is shown in greater detail in FIG. 2. The diverter casing 20 and diverter valve member 25 are described in great detail in the aforementioned Application of Henry R. Billeter. It should be noted generally, however, that whenever the spray arm 13 is in a substantially horizontal position as illustrated in FIG. 3 and the flush valve handle 8 is actuated to flush the toilet bowl, a portion of the water flowing through the flush pipe 7 and therefore through the chamber 21 (FIG. 3) defined by the rear portion 22 of diverter casing 20, is diverted through aperture 23 in diverter casing 20, seal 27 and aperture 26 in diverter valve member 25, and eventually through the spray arm 13 and spout 14 into a bedpan (not shown). This bedpan rinsing action takes place desirably at the same time the toilet bowl is being flushed.

Referring again to FIG. 2, a substantially cylindrical deoseptic valve member 30, having a large diameter portion 37 and a smaller diameter portion 38, is fixedly attached to diverter valve member 25 by brazing 31 or by any other suitable means. Deoseptic valve member 30 has cavitating venturi 32, passage 33, and bore 34 therein; and member 30 is attached to diverter valve member 25 so that the upstream end 36 of venturi 32 is in constant communication with aperture 26 in valve member 25. A housing 40 is mounted on the deoseptic valve member 30 and held by a retaining ring 41. A flow control 42 is threadably disposed in one end of passage 33. Housing 40 supports by threads 44 a container 45 which contains a sanitizing fluid (not shown). Container 45 might alternatively contain a deodorant, coloring, scent, any combination of the above, or any other substance which the user desires to have mixed with the flushing water being diverted through the spray arm 13. Extending into the container 45 is a tube 46 which has a filter 47 inserted in its lower end. The upper end of tube 46 is mounted on neck 48 of plug 49. Check valve 50 rests on seat 51 in plug 49, and plug 49 is held in place partially by vent pin 52 which is inserted through housing 40 and into plug 49 thereby assuring communication between atmosphere and passage 54 in plug 49. Plug 49 is secured to housing 40 by some suitable means such as an appropriate adhesive. Pin 52 is pressed into housing 40 and plug 49.

A chamber 60 is defined by housing 40, the smaller diameter portion 38 of deoseptic valve member 30, and the check valve 50. O-rings 61 and 62 prevent leakage from chamber 60 between deoseptic valve member 30 and housing 40 to the outside of deoseptic assembly 15. O-ring 63 prevents leakage from chamber 60 between deoseptic valve member 30 and flow control 42. O-rings 64 and 65 are described in the aforementioned Application of Henry R. Billeter and prevent water being diverted into diverter valve member 25 from leaking between diverter valve member 25 and diverter casing 20 to the outside of the bedpan rinsing apparatus 12.

DESCRIPTION OF THE OPERATION

When the spray arm 13 is rotated from the vertical "Off" position shown in FIG. 2 to the horizontal "On" position shown in FIG. 3, the diverter valve member 25 rotates with spray arm 13, and deoseptic valve member 30 rotates with diverter valve member 25. When the handle 8 is actuated to flush the toilet bowl 5 and the apparatus is in the "On" position shown in FIG. 3, water flows down flush pipe 7 into chamber 21. A portion of the water (as described in the aforementioned Application of Henry R. Billeter) is diverted through aperture 23 in diverter casing 20, through seal 27 and aperture 26 in diverter valve member 25, and into upstream end 36 of venturi 32. Under substantially constant pressure the flow is accelerated by virtue of the gradually decreasing diameter of venturi 32 in the direction of flow. There is a sharp increase in diameter or cavitating step in venturi 32 at 35 causing the flow to cavitate and consequently creating a region of low static pressure or vacuum at 35. It is in this region of vacuum at cavitating step 35 that passage 33 opens into venturi 32. The vacuum at the downstream end of passage 33 creates a vacuum in bore 34 and chamber 60. The resulting differential pressure across check valve 50 raises check valve 50 off of seat 51 and extends the vacuum into tube 46. Atmospheric pressure in container 45 maintained by vent pin 52 forces sanitizing fluid through filter 47, tube 46, past check valve 50, through bore 34 and passage 33 where it mixes with the water at cavitating step 35 in venturi 32. The mixture then flows out of venturi 32 into chamber 28 in diverter valve member 25 and out through spray arm 13 and spout 14 into the bedpan (not shown). Deoseptic valve member 30 has an angular cut 39 at the downstream end of cavitating venturi 32 which prevents restriction of the flow out of venturi 32 into chamber 28. The above described flow is depicted in FIG. 3 by arrows.

When spray arm 13 is returned to the vertical position shown in FIG. 2, seal 27 and aperture 26 are moved out of communication with aperture 23 thereby cutting off flow into the diverter valve assembly. The cessation of flow through cavitating venturi 32 causes the pressure to equalize throughout the deoseptic assembly thereby stopping the flow of sanitizing fluid from container 45.

By removing snap cap 43, flow control 42 may be manually adjusted into or out of deoseptic valve member 30 thereby restricting or enhancing flow through passage 33. Flow control 42 may be closed completely if the operator desires to use the bedpan rinsing apparatus without admixing the sanitizing fluid.

Housing 40 is restrained from rotating with deoseptic valve member 30 by vent pin 52 which is received in a notch 53 in diverter casing 20.

What is claimed is:

1. In combination, a flush valve together with a bedpan rinsing apparatus, a flush tube connecting said flush valve and a toilet fixture whereby operation of said flush valve causes water to flow into the toilet fixture, a diverter valve assembly supported on said flush tube, said assembly including a valve member rotatable therein, and having a spray arm attached to said valve member, said spray arm movable into and out of position with respect to said bedpan, said diverter valve member rotatable with said spray arm and having a flow passage therein arranged to permit water flow from said flush tube into said spray arm in one position of said spray arm, and to close off water flow in another position of said spray arm, a deoseptic assembly supported upon said diverter valve member and having a part rotatable therewith, said deoseptic assembly including a container of sanitizing liquid, means in said diverter valve responsive to movement of said spray arm into bedpan rinsing position and operation of said flush valve for causing water flow into the toilet fixture and into said spray arm, and means in said rotatable part of said deoseptic assembly responsive to said water flow for causing the sanitizing liquid in said container to mix with the water flow passing through said spray arm.

2. A bedpan rinsing apparatus connected between a flush valve and a toilet fixture including a diverter casing supported in said connection, a diverter valve member rotatable in said diverter casing, a spray arm attached to said diverter valve member, said spray arm movable into and out of bedpan rinsing position, said diverter valve member being rotatable by movement of said spray arm, said diverter casing and said diverter valve member having communicating flow passages open when the spray arm is moved into bedpan rinsing position and closed in the alternate position, the operation of said flush valve resulting in water flow through said flow passages into said spray arm when the spray arm is moved into bedpan rinsing position, a deoseptic apparatus supported on said diverter valve member, said deoseptic apparatus including a valve member rotatable with said diverter valve member and having a flow passage therein communicating with the flow passage in said diverter valve member, a housing for said deoseptic apparatus supported upon said deoseptic valve member, said deoseptic valve member rotatable in said housing, a sanitizing fluid container supported on said housing, and valve means in said housing controlling flow passages extending from said fluid container into said deoseptic valve member and into said diverter valve member for mixing the sanitizing fluid with the water flowing into said spray arm by aspiration.

3. The bedpan rinsing apparatus as claimed in claim 2 in which said deoseptic housing is locked to said diverter casing to prevent the housing from rotating along with the deoseptic valve member.

4. The bedpan rinsing apparatus as claimed in claim 3 in which the locking means comprises a hollow tube to also extend atmospheric pressure into the sanitizing container.

5. The bedpan rinsing apparatus as claimed in claim 4 in which the hollow tube is fixed to said housing at one end and fits into a groove in the diverter casing at its other end.

6. The bedpan rinsing apparatus as claimed in claim 2 in which the valve means in the deoseptic housing comprises a check valve controlling the passage of sanitizing fluid from the fluid container into said deoseptic valve member.

7. The bedpan rinsing apparatus as claimed in claim 2 in which the deoseptic valve member is fixedly secured to one end of said diverter valve member and at the other end to said deoseptic housing and is rotatable with said diverter valve member.

8. The bedpan rinsing apparatus as claimed in claim 2 in which the deoseptic housing and the diverter valve member are both hollow and the deoseptic valve member extends into both hollow portions, the deoseptic valve member being rotatable together with said diverter valve member and rotatable inside the hollow deoseptic housing.

9. The bedpan rinsing apparatus as claimed in claim 8 in which sealing means are provided between said deoseptic valve member and said deoseptic housing.

10. A bedpan rinsing apparatus including a diverter casing and assembly having a hollow diverter valve member rotatable in said casing, a spray arm attached to said diverter valve member for rotating said diverter valve member when the spray arm is moved to bedpan spraying position, a deoseptic assembly including a deoseptic valve member attached to one end of said diverter valve member and rotatable therewith, a housing supported upon deoseptic valve member, said deoseptic valve member rotatable in said housing and having flow passages therein extending into said diverter valve member, means for locking the other end of said deoseptic valve member to said housing while permitting rotation of said deoseptic valve member, sealing means between said housing and said deoseptic valve member, adjustable flow control means in said deoseptic valve member for controlling the flow passages therein, a check valve in said housing, a container of sanitizing fluid supported from said housing having a fluid passage leading into said deoseptic valve member controlled by said check valve, and means responsive to water flow into said diverter valve and with the spray arm moved to bedpan rinsing position for aspirating the sanitizing fluid from said container, through said deoseptic valve member passages into said diverter valve member to mix with the water flow as it passes into said spray arm.

11. The bedpan rinsing apparatus as claimed in claim 10 in which the deoseptic valve member has flow passages therein for the flow of sanitizing fluid into the diverter valve member, and in which the flow passages are constructed to provide an aspirating effect to draw the sanitizing fluid from the container and mix the fluid with the water flow into the spray arm.

12. The bedpan rinsing apparatus as claimed in claim 10 in which the flow control valve is located in the flow passage of the deoseptic valve member and is accessible for adjustment from outside the housing.

13. The bedpan rinsing apparatus as claimed in claim 10 in which the end of the deoseptic valve member is rotatably locked to the housing by a snap ring and in which sealing means are provided between the housing and the deoseptic valve member.

14. A deoseptic valve assembly associated with a diverter valve apparatus for rinsing bedpans, said diverter valve apparatus including a diverter valve member rotatable within a supporting casing, a deoseptic valve member attached to said diverter valve member and rotatable therewith, a housing for said deoseptic valve member within which said deoseptic valve member is rotatable, means for rotatably coupling said deoseptic valve member to said housing, said deoseptic valve member having flow passages therein extending into said diverter valve member, said flow passages constructed to provide an aspirating effect to fluid flow through said passages, a flow regulating valve in said deoseptic valve member for regulating fluid flow through said passages, a check valve in said housing for preventing back flow in said fluid flow passages, a container of sanitizing fluid attached to said housing and having a flow passage leading into the flow passages of said deoseptic valve member, and a spray arm attached to said diverter valve member for rotating said diverter valve member when the spray arm is moved to bedpan rinsing position, the sanitizing fluid being mixed with the water flow through said spray arm in the bedpan rinsing position.

15. The bedpan rinsing apparatus as claimed in claim 10 in which the means for aspirating the sanitizing fluid is a cavitating venturi comprising a venturi passage the diameter of which gradually decreases in the direction of flow to a point at which the passage sharply increases in diameter and remains at a substantially constant diameter thereafter, and a second flow passage that is substantially perpendicular to the venturi passage, said second passage having its downstream end opening into the venturi passage at a point immediatey downstream of the sharp increase in the venturi passage, the upstream end of said second passage being in communication with the sanitizing fluid, and the upstream end of the venturi passage being in communication with water flow into the diverter valve.

16. The bedpan rinsing apparatus as claimed in claim 15 in which the sharp increase in diameter of the venturi passage is a step increase.

* * * * *